US006227397B1

(12) United States Patent
Kim

(10) Patent No.: US 6,227,397 B1
(45) Date of Patent: May 8, 2001

(54) VARIABLE HEIGHT CONTAINER FOR VESSEL

(76) Inventor: Jum-kyu Kim, 1308-306 Mokdong Apt., Shinjeong-dong, Yangcheon-gu, Seoul (KR)

( * ) Notice: Subject to any disclaimer, the term of this patent is extended or adjusted under 35 U.S.C. 154(b) by 0 days.

(21) Appl. No.: 09/474,754

(22) Filed: Dec. 29, 1999

(30) Foreign Application Priority Data

Dec. 30, 1998 (KR) ..... 98-27788
Jun. 18, 1999 (KR) ..... 99-10885

(51) Int. Cl.[7] ..... B65D 6/16
(52) U.S. Cl. ..... 220/8; 220/1.5; 220/4.28
(58) Field of Search ..... 220/1.5, 6, 8, 4.28; 206/600

(56) References Cited

U.S. PATENT DOCUMENTS 3,459,326 * 8/1969 Betjemann .
3,591,033 * 7/1971 Partridge ..... 220/1.5
4,036,361 * 7/1977 Jacobson et al. ..... 206/597
4,714,169 * 12/1987 Keenan et al. ..... 220/8
5,370,256 * 12/1994 Fourie et al. ..... 220/6

* cited by examiner

*Primary Examiner*—Stephen Castellano
(74) *Attorney, Agent, or Firm*—Reed Smith Hazel & Thomas L

(57) ABSTRACT

A variable height container for a vessel of which the upper side is open includes a bottom plate where freight is placed, a plurality of fixed posts installed on the bottom plate, a mobile post installed at each of the fixed posts to be capable of moving up and down by being guide by the fixed post to adjust the height of the container, and a fixing deice for fixing the mobile post to the fixed post so that the height of the mobile post can be fixed. Thus, the cost for transportation can be reduced, mass transportation can be possible, shipping is possible any shipping places, freight can be loaded anywhere on a deck of a ship or inside the ship. Also, rapid and free transportation can be available and the container can be folded by being folded so that a freight space can be reduced.

1 Claim, 10 Drawing Sheets

PRIOR ART

VARIABLE HEIGHT CONTAINER FOR VESSEL

BACKGROUND OF THE INVENTION

1. Field of the Invention

The present invention relates to a container for a vessel whose height can be adjusted, and more particularly, to a variable height container for a vessel having mobile posts for adjusting the height thereof so that more freight can be easily shipped and the cost for carrying freight can be reduced.

2. Description of the Related Art

In general, a container for a vessel is a box used for containing freight and is manufactured according to the designated specifications so that it can be used in relation with various transportation methods. By using the container, shipping and discharging work can be mechanized, the cost for packaging can be reduced, and the possibility of theft can prevented. Also, as a number of containers can be piled up on a vessel, a large amount of freight can be transported at once on the sea.

There are many kinds of containers manufactured according to the type of freight such as a refrigerator container, a cold insulation container, a ventilation container, a bulk container, or a tank container in addition to a general dry container. In particular, to carry over-dimension freights such as steel, wood, or pipes and heavy freights such as machines, yachts, factory parts, or mechanical parts, a specially manufactured flat rack container is used. The flat rack container has the upper and lateral sides detached so that the weight of the containers piled up vertically is supported by only the four corner posts thereof.

An example of the conventional flat rack container is shown in FIG. 1. As shown in the drawing, the conventional flat rack container 110, in which the upper and lateral sides are detached, consists of a bottom plate 112 on which freight 1 is placed and four corner posts 114 vertically fixed at the four corners of the bottom plate 112.

Each of the four corner posts 114 has a corner cast 118 formed on the top end thereof. Here, through holes are formed in the upper surface and side surfaces of the corner cast 118 to be hooked by a hook of a spreader 2 which is a container moving apparatus. Thus, when the container is moved, the flat rack container 110 which is directly coupled to the spreader 2 through hooking is lifted and moved by a crane (not shown) at a wharf to be placed on a vessel.

However, when freight contained in the flat rack container 110 is so lengthy in the height than the height of the post of the flat rack container 110 so that the top end of the freight contacts the spreader. Thus, the corner cast 118 is hindered from being hooked by the spreader 2.

Accordingly, to carry the freight 1 placed in the conventional flat rack container 110, as shown in FIG. 1, a wire rope 7 having a hook 6 installed at the end thereof is used. The hook 6 is hooked into the holes of the corner cast 118 and the container 110 is moved from a vessel. Alternatively, the flat rack container 110 and the freight 1 are separately moved on a vessel and then the freight 1 is loaded in the container 110 on a vessel.

Hence, in the case of the conventional flat rack container 110, the cost for labor increases and the time for moving the freight is lengthened due to the above wire rope installation work or re-shipping process. Also, there is the possibility the freight in the container may fell out during movement thereof as the wire rope 7 sways and breaks due to the weight of the freight.

Also, as other containers cannot be loaded on and above the conventional flat rack container 110 loaded with high freight exceeding the height of the container as much as height OH, as shown in FIG. 2, the over-height container is restricted to be placed on top of the piled containers each having an identical specified container height H or on the bottom surface 4 of a vessel.

Therefore, according to the present transportation cost calculation method, a fee for the unused space S above the over-height container is unnecessarily included in the total cost. Also, as the space for such an over-height flat rack container is actually limited to the top portion of the piled containers, the conventional flat rack container 110 has to wait on the wharf until the appropriate space is prepared. Further, the number of containers to be transported are limited and the containers must be re-loaded at the next harbor.

SUMMARY OF THE INVENTION

It is an objective of the present invention to provide a variable height container for a vessel by which the spreader is directly coupled to the corner cast so that labor cost and the time for shipping can be considerably reduced and shipping work is performed safely.

It is another objective of the present invention to provide a variable height container for a vessel by which other containers can be heaped on and above the same so that the cost for unnecessary space can be reduced, and of which the posts and can be folded so that the space for storing the container can be reduced.

Accordingly, to achieve the above objective, there is provided a variable height container for a vessel of which the upper side is open, which comprises a bottom plate where freight is placed, a plurality of fixed posts installed on the bottom plate, a mobile post installed at each of the fixed posts to be capable of moving up and down by being guide by the fixed post to adjust the height of the container, and a fixing means for fixing the mobile post to the fixed post so that the height of the mobile post can be fixed.

It is preferred in the present invention that the mobile post is piston-shaped and slides along the fixed post while a part thereof is inserted into spaced formed in the fixed post, the fixing means comprises a fixing pin concurrently penetrating a pin hole formed in the mobile post and a pin hole formed in the fixed post, and safety pins penetrating one end of the fixing pin to prevent the fixing pin from escaping from the pin holes.

It is preferred in the present invention that the mobile post is piston-shaped and slides along the fixed post while a part of the mobile post is inserted into a space formed in the fixed post, and the fixing means comprises a stopper installed at the mobile post to be capable of moving back and forth to be inserted into or escaped from a hooking groove formed in an inner wall of the fixing post, a cam assembly allowing the stopper to move back and forth while rotating, and a handle connected to the cam assembly for rotating the cam assembly.

Also, it is preferred in the present invention that the fixed post is hinge-coupled to the bottom plate to be capable of being folded, and a fixing means for fixing the position of the fixed post folded is installed at the bottom plate.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
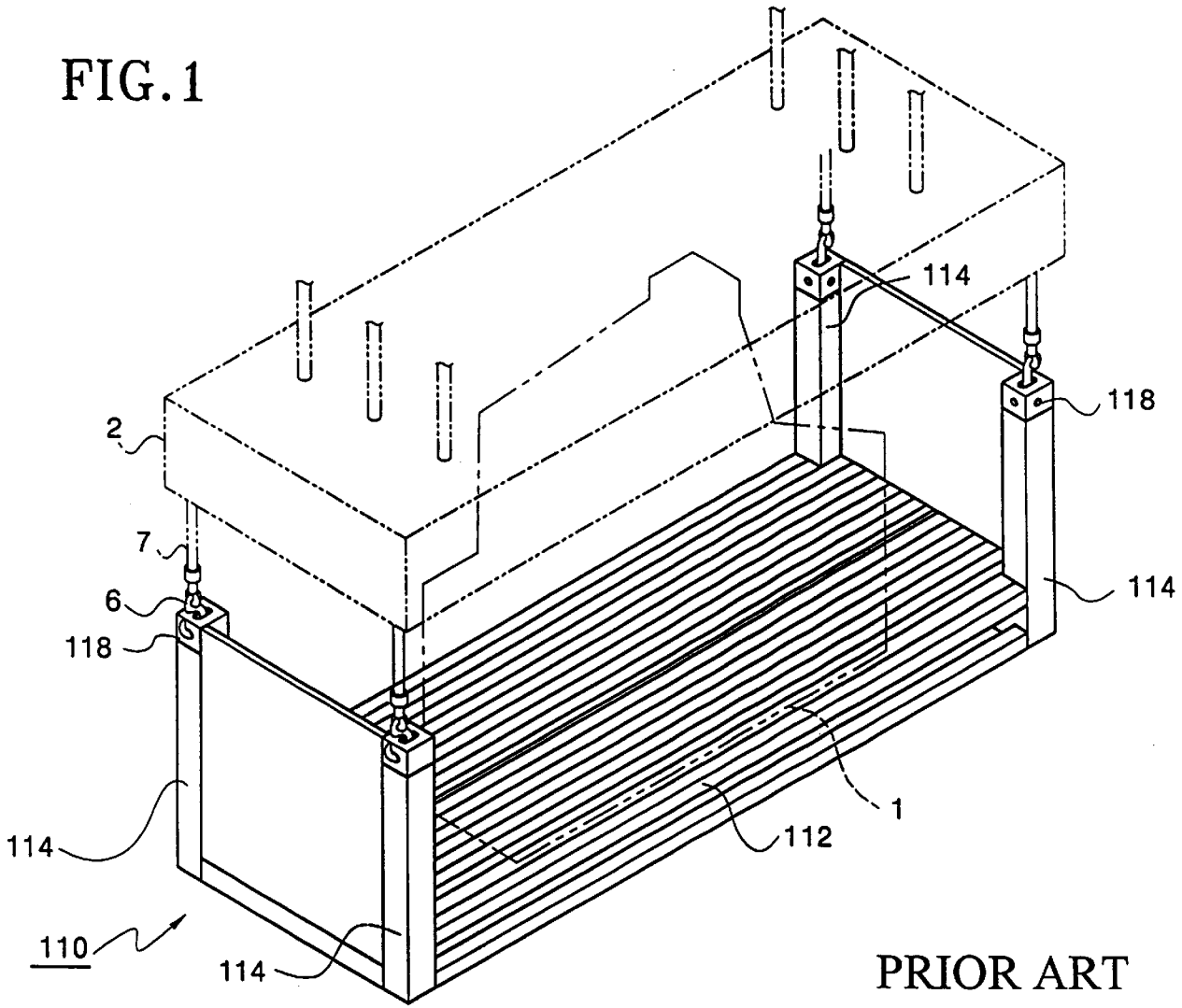
FIG. 1 PRIOR ART
FIG. 1 is a perspective view showing a conventional container for a vessel.
Figure 2:
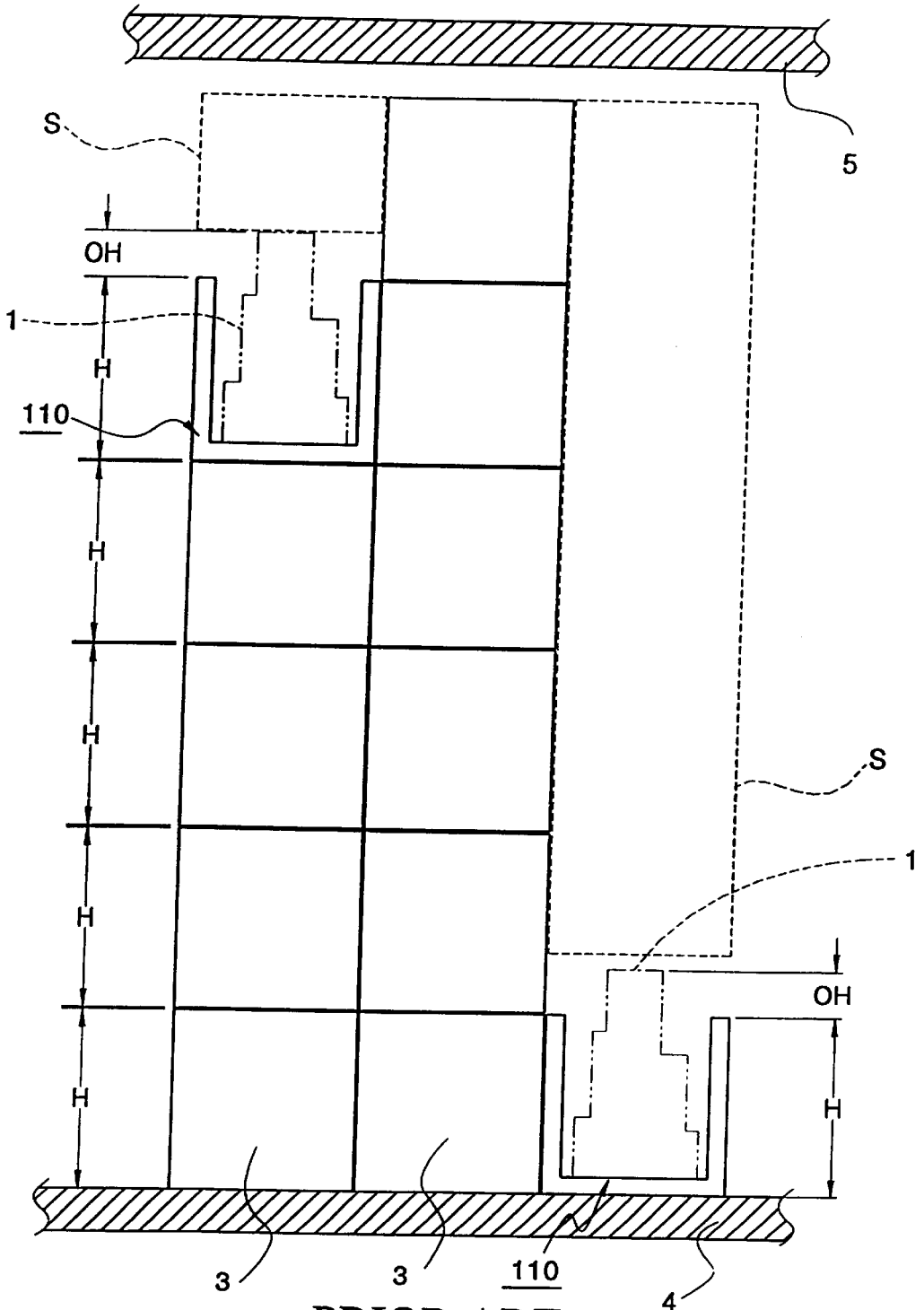
FIG. 2 is a view showing the positions of the over-height flat rack container among the piled up containers.
Figure 3:
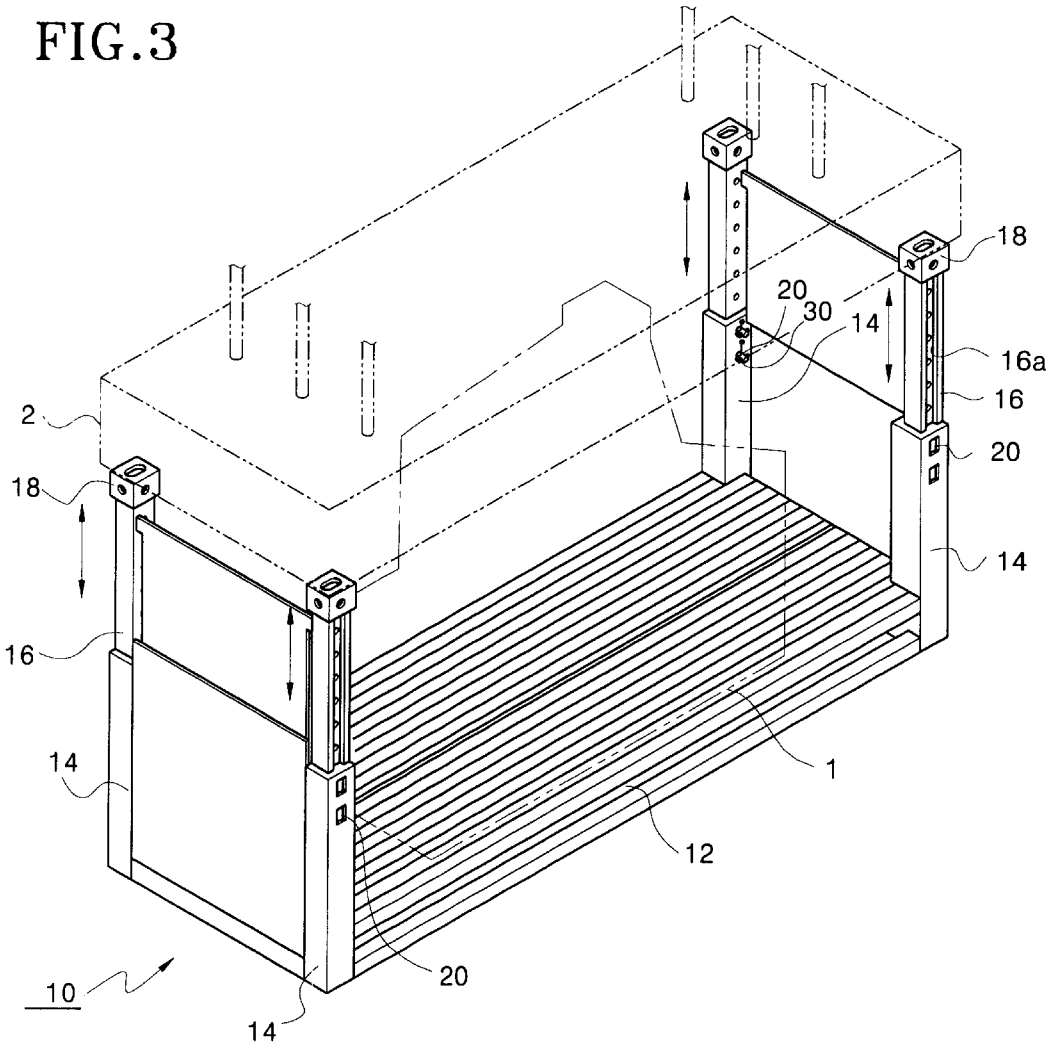
FIG. 3 is a perspective view showing a variable height container for a vessel according to the first preferred embodiment of the present invention.

Referring to FIG. 3, a variable height container 10 for a vessel according to the present invention, which is a flat rack container for a vessel open at the upper and lateral sides, includes a bottom plate 12 on which the freight 1 is placed, a fixed post 14 having space inside and fixedly installed at each of the four corners of the bottom plate 12, and a mobile post 16 having a corner case 18 formed at one end thereof. The other end of the mobile post 16 is inserted in the space of the fixed posts 14 to be capable of sliding so that the height of the container 10 can be adjusted.

Here, it is possible to have the fixed post 14 hinge-coupled to the bottom plate 12 to be capable of being folded as necessary. Thus, the container 10 in the unloaded state can be conveniently stored.

Also, through-holes are formed in the corner cast 18 installed at the upper end of the mobile post 16 so that the corner case 18 can be directly coupled by a hook (not shown) of the spreader 2. Here, the height of the mobile post 16 can be easily adjusted by manually sliding the mobile post 16 along the fixed post 14. For that purpose, other various power sources or power transmission means such as a hydraulic cylinder, a pneumatic cylinder, a jack, or a height adjustment screw can be used.

Figure 4:
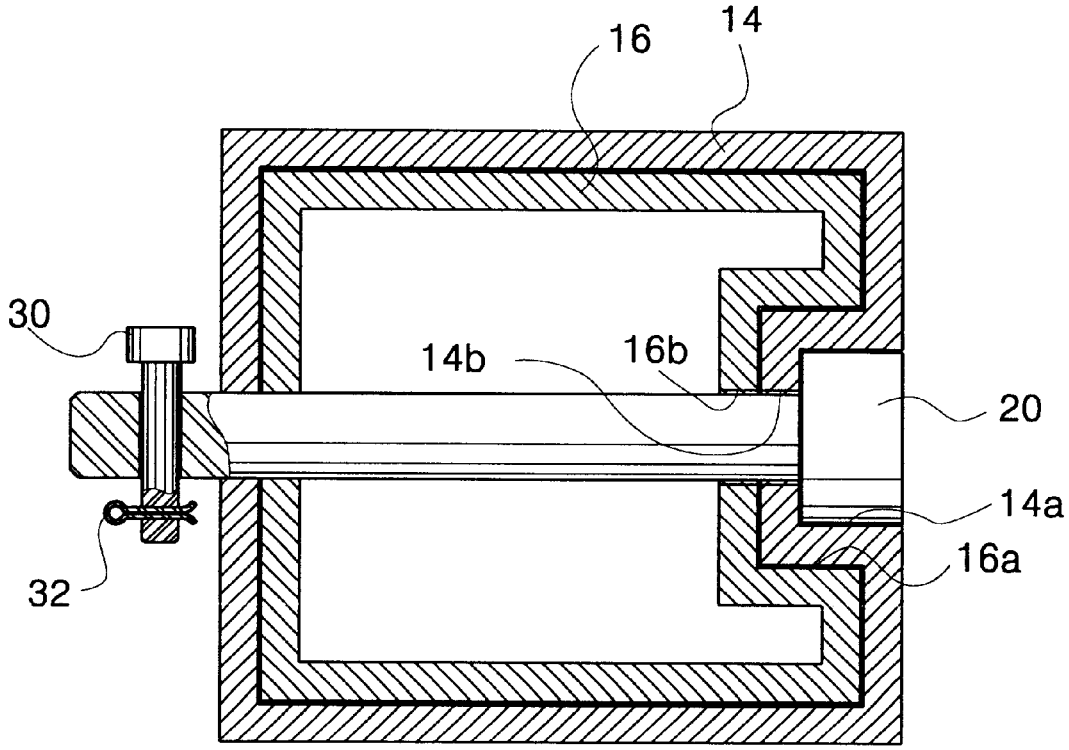
FIG. 4 is a sectional view showing the state in which a fixed post and a mobile post shown in FIG. 3 are coupled by a fixing pin.

In the variable height container 10 for a vessel according to the present invention, a fixing pin 20 and a safety pin 30 are used as a fixing means for fixing the mobile post 16 to the fixed post 14. When the height of the mobile post 16 is appropriately adjusted, as shown in FIG. 4, the fixing pin 20 is concurrently inserted into a pin hole 14*b* formed in the fixed post 14 and a pin hole 16*b* formed in the mobile post 16. Then, the safety pin 30 is inserted into a hole formed in one end of the fixing pin 20 to prevent the fixing pin 20 from escaping from the pin holes 14*b* and 16*b*.

The fixing pin 20 can be installed at one position at each fixed post 14 or at two or more positions for the purpose of safety. Preferably, a plurality of pin holes 16*b*, e.g., two through twelve units, are formed in the mobile post 16 at intervals of about 0.5–3.0 inch. There are various types of fixing pins 20 such that one end inserted is bent, one end inserted is rotated, or one end inserted elastically expands, which can be easily modified and corrected by persons in the art.

A recess 14*a* where the head of the fixing pin 20 is inserted is formed at one side of the fixed post 14. A lengthy groove 16*a* is formed at one side of the mobile post 16 to correspond to the recess 14*a* of the fixed post 14. The recess 14*a* is manufactured corresponding to the shape of the head of the fixing pin 20. There can be various shapes and positions of the lengthy groove 16*a* such as a round lengthy groove, a triangular lengthy groove, instead of the rectangular lengthy groove shown in the drawing. Also, the same recess and lengthy groove as above can be formed at the fixed post 14 and the mobile post 16, respectively, so that the other end of the head of the fixing pin 20 cannot be projected above the outer surface of the fixed post 14. Thus, the intensity of the mobile post 16 increases and the fixed pin 20 does not interfere with other adjacent containers during shipping.

Also, it is possible to install an extension plate between a pair of mobile posts 16 so that the extension plate can be moved up and down along with the mobile posts 16. The extension plate can protect the freight 1 from being exposed to the outside and allows stable and smooth movement by coupling the mobile posts 16.

As shown in FIG. 3, when freight having a height exceeding the height of the fixed post 14 is loaded in the variable height container 10 for a vessel, the mobile post 16 is extended such that the top of the freight cannot contact the bottom surface of the spreader 2 or the bottom surface of other container put thereon. Next, the fixing pin 20 is concurrently inserted into the pin hole 16*b* of the mobile post 16 and the pin hole 14*b* of the fixed post 14 to fix the height of the mobile post 16. Then, to prevent escape of the fixing pin 20, the safety pin 30 is inserted into the hole formed in the fixing pin 20.

Next, the hook of the spreader 2 is directly coupled to the corner cast 18 and the spreader 2 lifts the container to place the same on the vessel. Thus, when the container 10 loaded with the freight 1 is moved, there is no need to use additional wire rope or equipment up to the height that the mobile post 16 can extend. The spreader 2 is lowered and directly coupled to the corner cast 18 extended corresponding to the height of the freight so that rapid and safe movement of the container to the vessel can be made possible.

Figure 5:
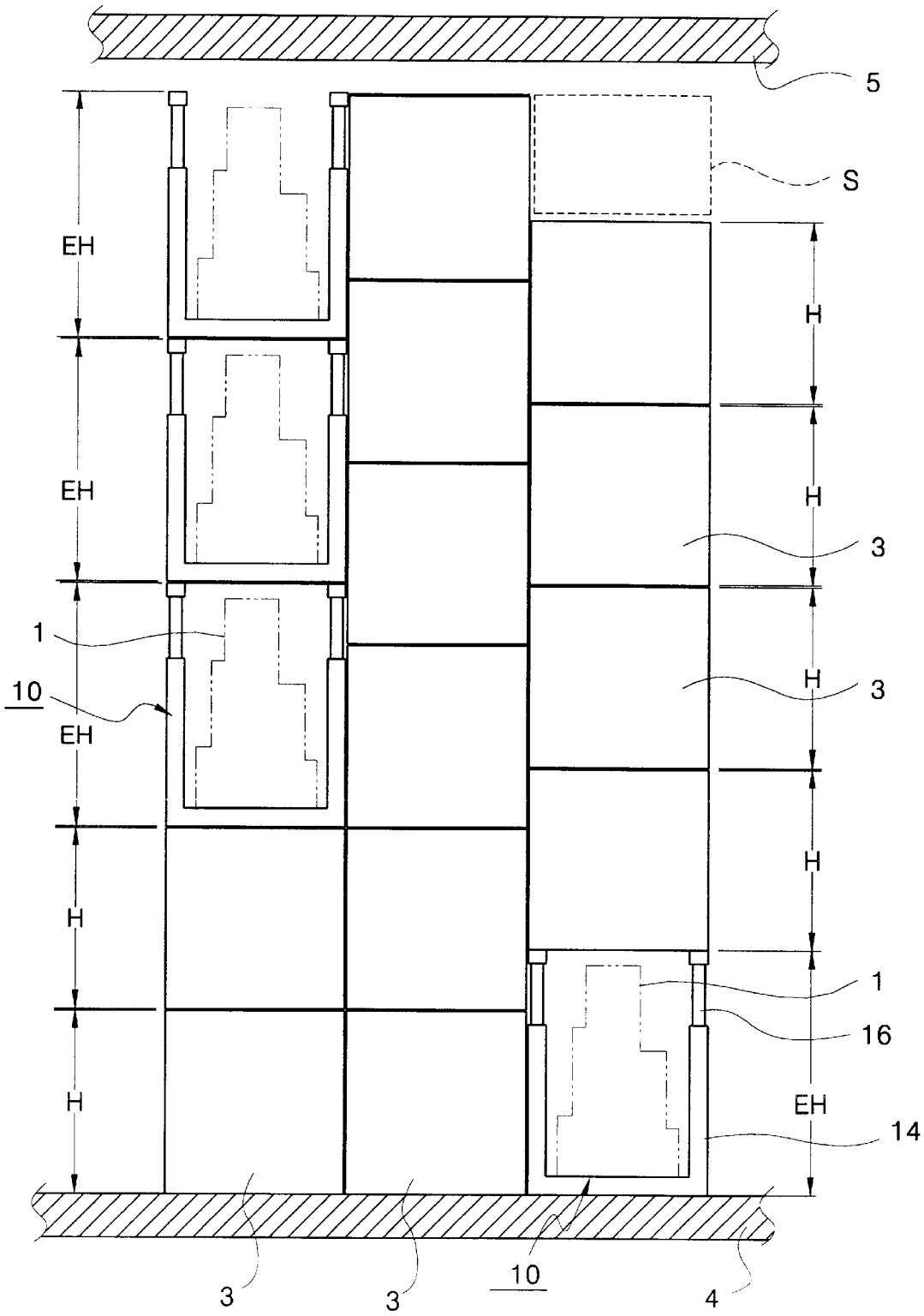
FIG. 5 is a view showing a state in which the variable height containers for a vessel loaded with freight which is higher than a designated height are piled up among a regular-sized containers.

As shown in FIG. 5, in the variable height container 10 for a vessel, the freight 1 does not interfere with other regular-sized containers as the mobile post 16 extends over the height of the freight 1. Also, other containers 3 of a designated size or other flat rack containers can be piled on and above the variable height container 10 so that unused space in the vessel can be reduced or removed.

That is, during shipping, as other different sized containers 3 can be stacked on and above the flat rack container 10, the variable height container 10 for a vessel according to the present invention having the extended height EH is put on the bottom surface 4 of the vessel and the upper surface of the deck 5. Also, the flat rack container 10 of the present invention can be positioned and stacked between the regular-sized containers 3 having the designated height, e.g., a dry container, or between other flat rack containers 10.

Thus, additional cost for unused space S can be drastically reduced. As there is no limits in shipping the flat rack container 10, it is advantageous that expensive fees as in the case of the conventional container need not be paid or the flat rack container 10 can be timely shipped without further waiting for the next opportunity when the space for the container is allowed.

Figure 6:
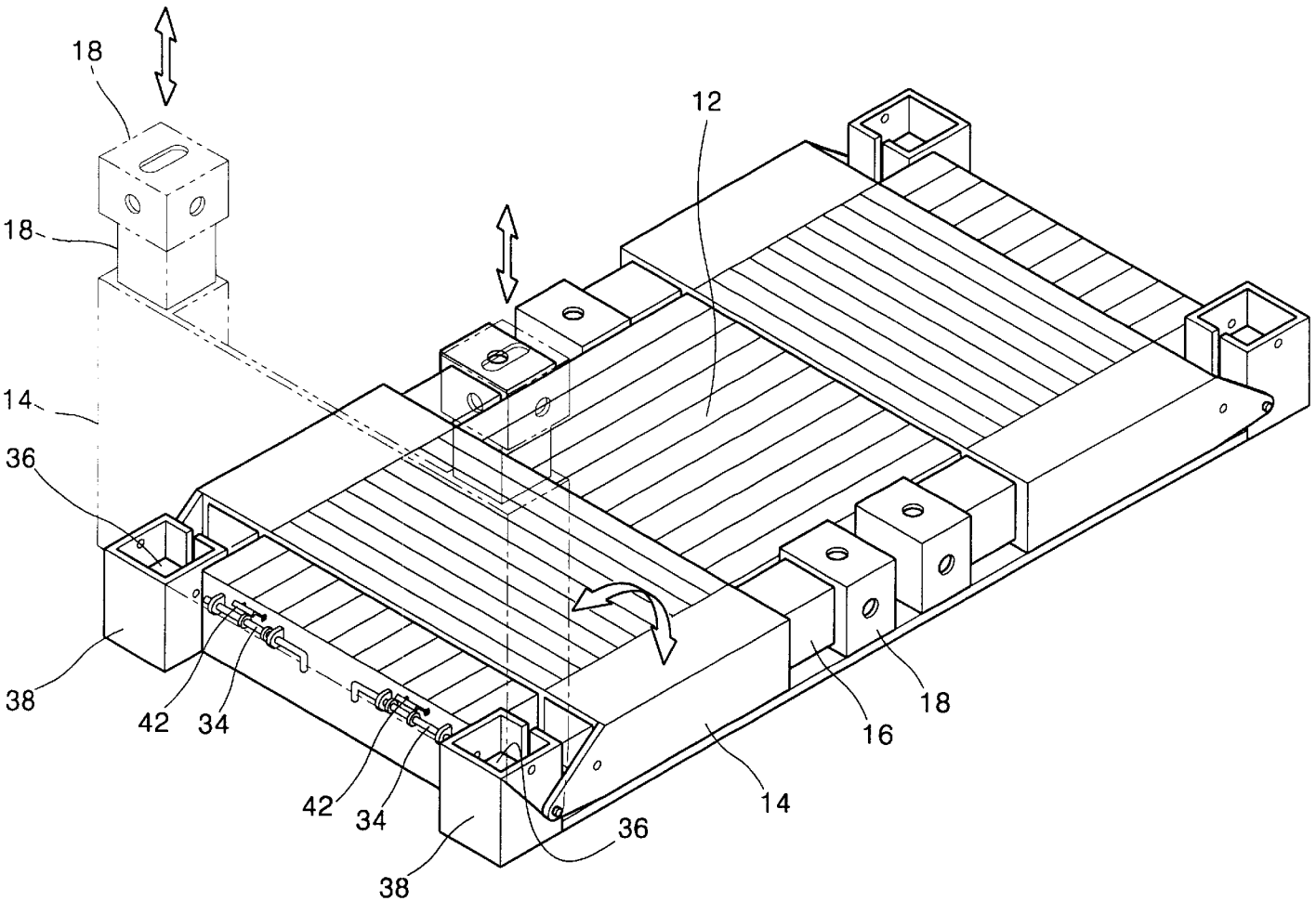
FIG. 6 is a perspective view showing a variable height container for a vessel according to another preferred embodiment of the present invention.

FIG. 6 shows a variable height container for a vessel according to another preferred embodiment of the present invention. In the variable height container for a vessel according to another preferred embodiment of the present invention, to reduce the space occupied by the container during storage, the fixed post 14 is hinge-coupled to the bottom plate 12 to be capable of being folded thereon and a bar 34 and a hooking post 36 are installed at the bottom plate 12 as a fixing means for fixing the fixed post 14 to the bottom plate 12.

Here, although the fixed post 14 and the bottom plate 14 can be hinge-coupled in various ways, it is preferable that two fixed posts 14 are coupled in pairs and hinge-coupled at the side surface of the bottom plate 12. Thus, the fixed post 14 is folded over and fits in a groove (not shown) formed at both sides of the bottom plate 12 during storage, while the fixed post 14 pivots around the hinge point of the bottom plate 12 and is erected vertically when freight is to be loaded, i.e., when used.

Also, as one example of many diverse fixing means to fix the position of the fixed post 14 vertically erected for use, there are the bar 34 capable of sliding back and forth installed at one side of the bottom plate 12 and a fixed post supporting post 38 fixed to the bottom plate 12. The fixed post supporting post 38 is connected to the inside of the fixed post 14 and contacts the lower portion of the fixed post 14 when the fixed post 14 is erected vertically so that the fixed post 14 is supported. Also, the hooking post 36 of a box shape is installed in the fixed post supporting post 38 to be capable of moving up and down along the inside of the fixed post 14 vertically erected in use and the fixed post supporting post 38 which are connected, and the position thereof is fixed by the bar 34.

Figure 7:
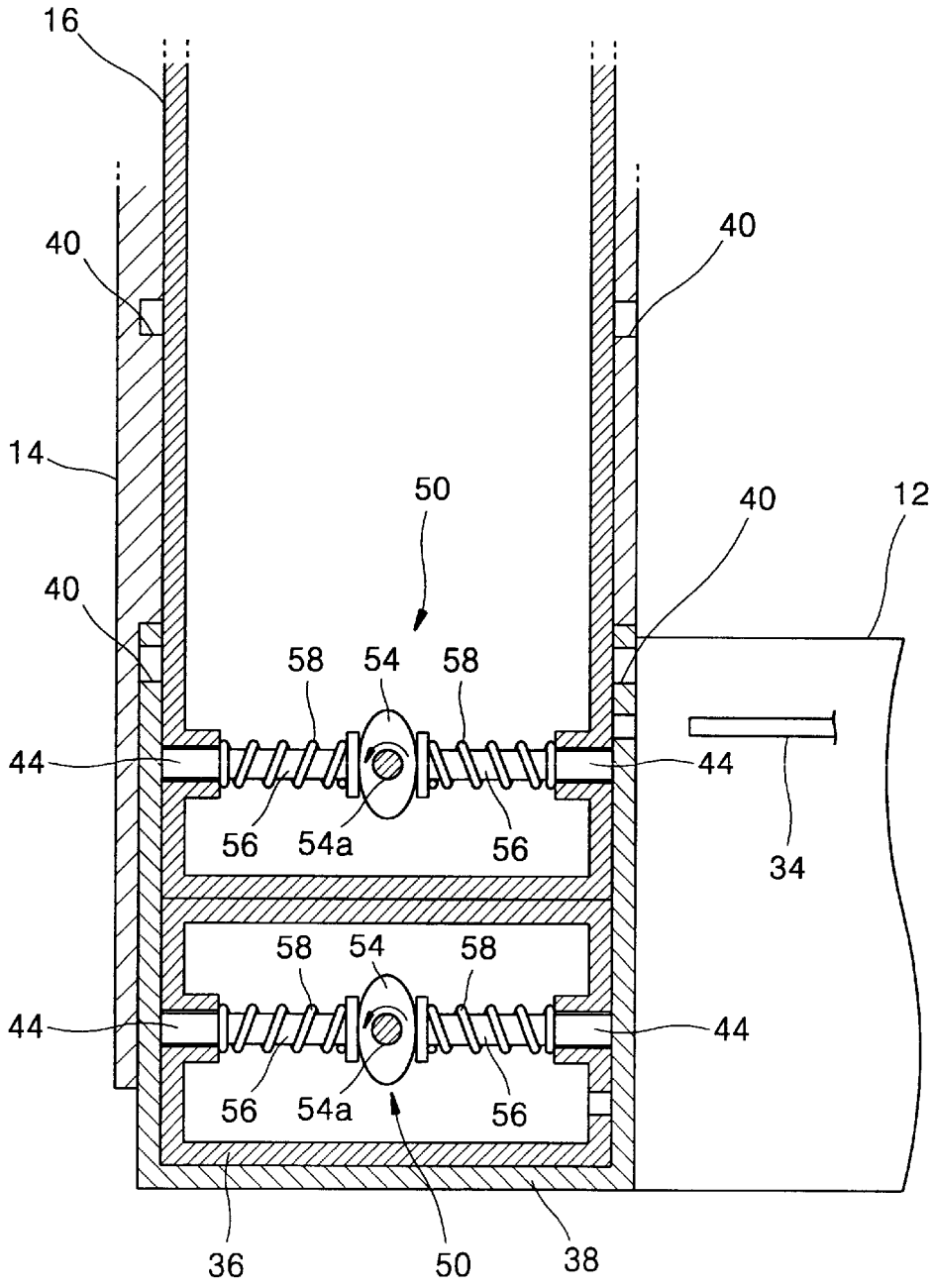
FIGS. 7 and 8 are vertical sectional view showing the operational state of the fixed post, the mobile post and a support post of FIG. 6 which are erected vertically.
Figure 8:
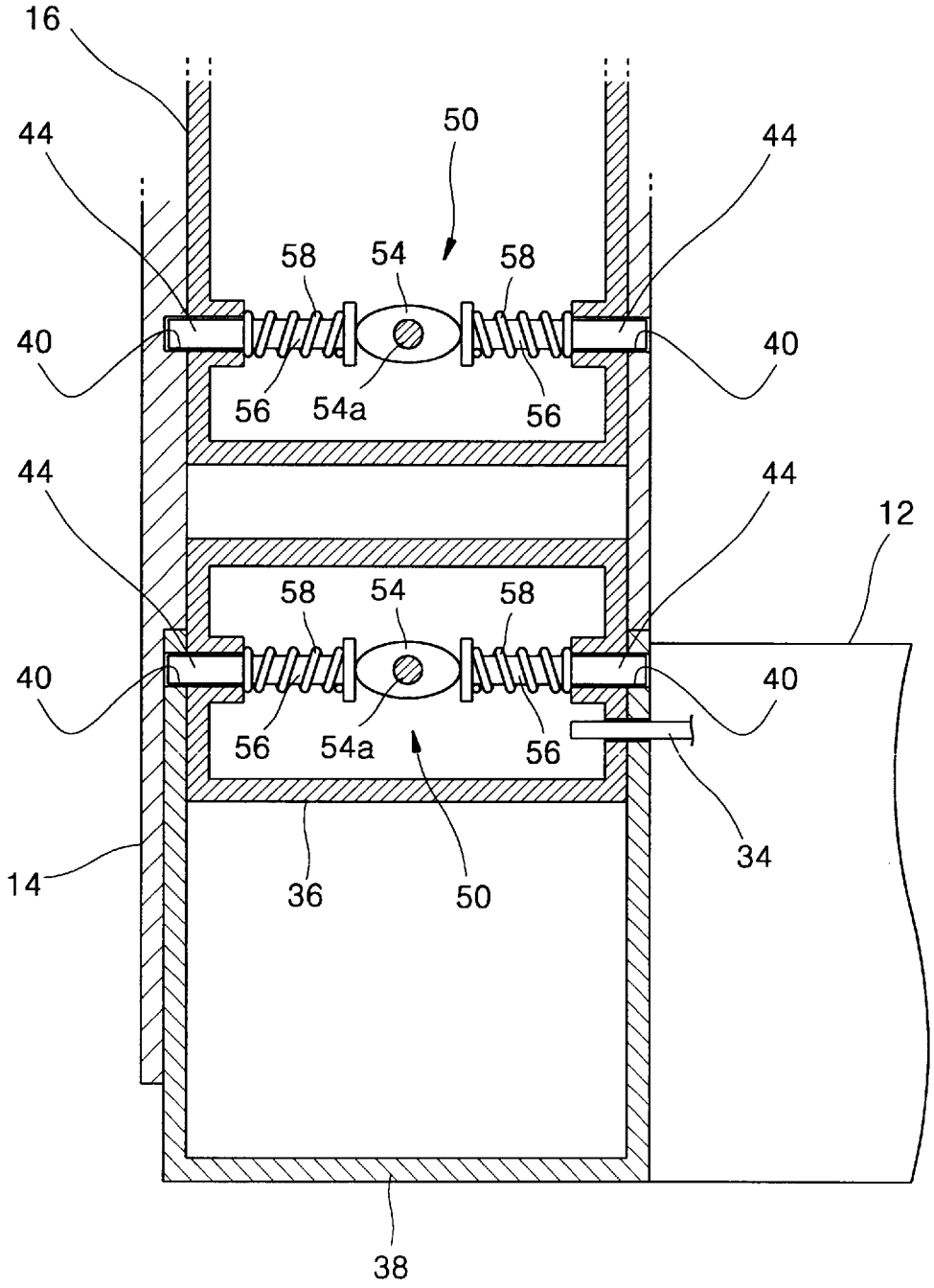

Here, as shown in FIG. 7, when the fixed post 14 is vertically erected and contacts the fixed post supporting post 38, the hooking post 36 remains inside the fixed post supporting post 38 (FIG. 7). Then, the hooking post 36 rises and is located between the fixed post supporting post 38 and the fixed post 14, as shown in FIG. 8, so that the fixed post 14 firmly stands with respect to the fixed post supporting post 38 and the fixed post 14 is prevented from falling down onto the bottom plate 12.

Also, the bar 34 penetrates both the hooking post 36 and the fixed post supporting post 38 to fix the position thereof. Here, the bar 34 is fixed by a hook 42 at the advanced or retreated position.

As a means for fixing the height of the mobile post 16, various types of fixing means can be used in addition to the above-described pin fixing type method. As shown in FIGS. 7 and 8, a stopper fixing method is used which includes a stopper 44 installed at the mobile post 16 to be capable of moving back and forth to be inserted into and escape from a hooking groove 40 formed in the inner surface of the fixed post 14, a cam assembly 50 for making the stopper 44 advance and retreat as it rotates, and a handle (see FIGS. 9 and 10) connected to the cam assembly 50 to rotate the cam assembly 50.

Here, the cam assembly 50 consists of an oval cam 54, a push rod 56 moving back and forth by the cam 54, and a spring 58 applying a restoring force in a direction in which the push rod 56 retreats. A stopper 44 is formed at one end of the push rod 56 to be inserted into and to escape from the hooking groove 40 formed in the inner surface of the fixed post 14.

Referring to FIG. 7, when the oval cam 54 is rotated by the handle 52 such that the interval between the push rods 56 facing each other decreases, the stopper 44 retreats by a restoring force of the spring 58. Thus, the mobile post 16 and the hooking post 36 are able to freely move up and down inside the fixed post 14 and the fixed post supporting post 38. When the oval cam 54 is rotated such that the interval between the push rods 56 facing each other increases, the stopper 44 advances overcoming the restoring force of the spring 58 so that it is inserted into the hooking groove 40 formed in the fixed post 14. Thus, the mobile post 16 and the hooking post 36 can be moved up and down freely inside the fixed post 14 and the fixed post supporting post 36 so that the height in moving up and down can be adjusted.

Also, as shown in FIGS. 7 and 8, the stopper fixing method can be applied to the hooking post 36. In addition to the above, to firmly fix the hooking post 36, as shown in FIG. 8, it is possible to advance the bar 34 to penetrate the fixed post supporting post 38 and the hooking post 36.

Figure 9:
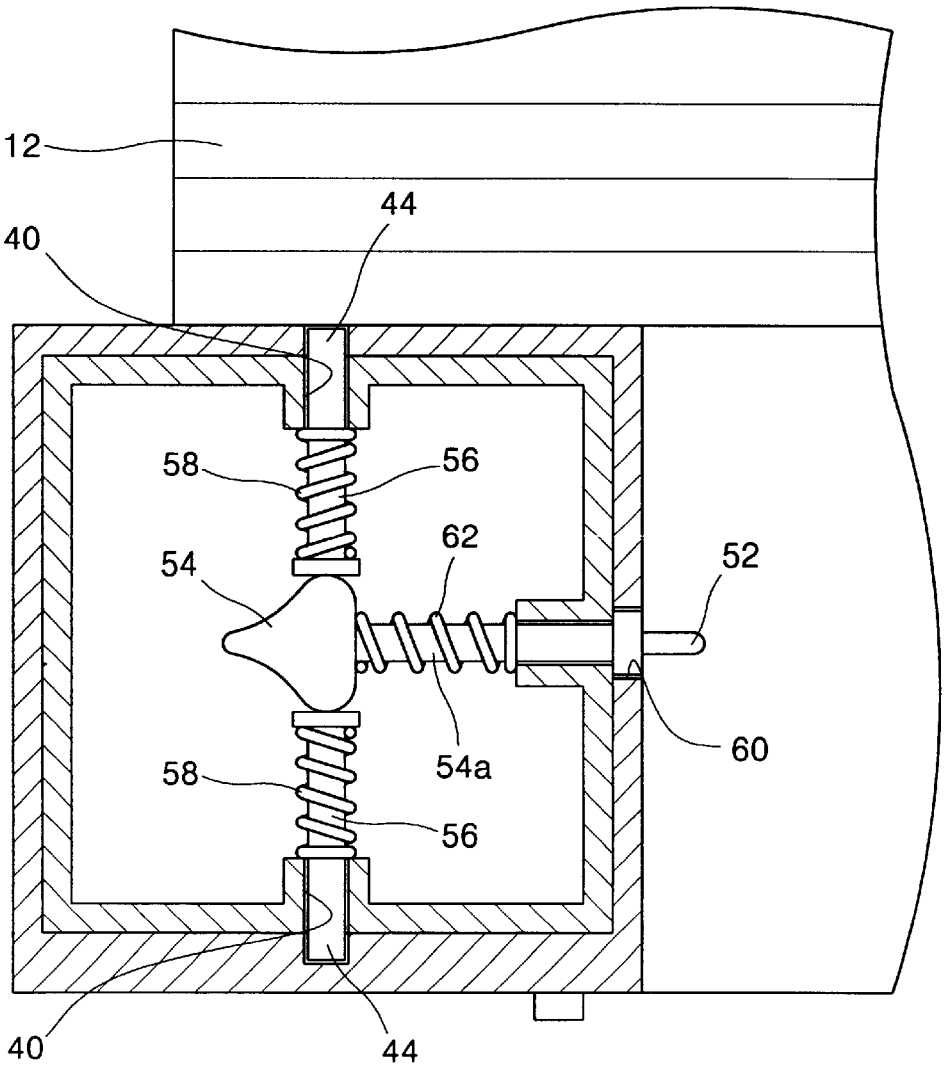
FIGS. 9 and 10 are cross-sectional views showing the operational state of the fixed post, the mobile post and a support post of FIG. 6 which are erected vertically.
Figure 10:
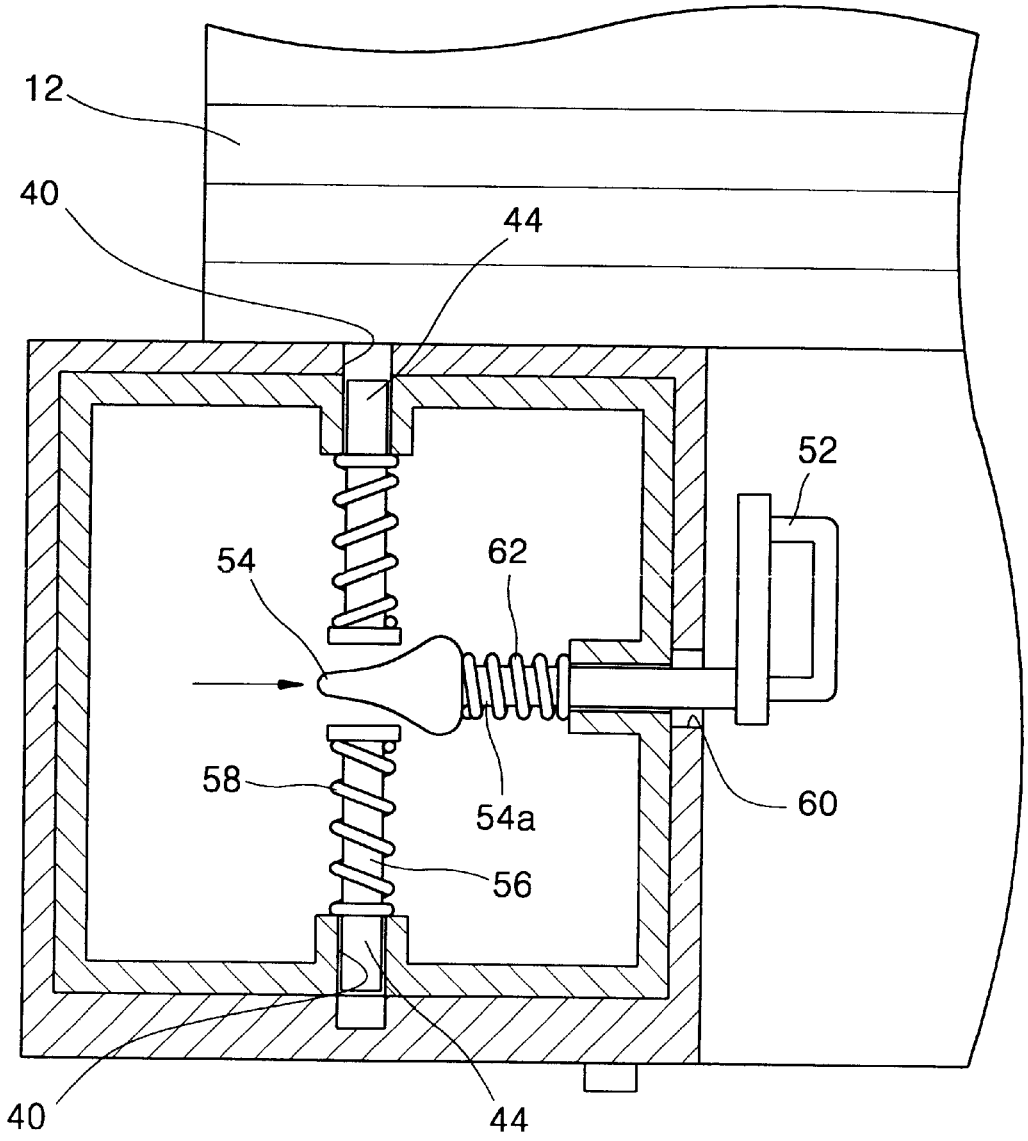

Here, as shown in FIGS. 9 and 10, a slit 60 is formed in one side surface of the fixed post 14 and the fixed post supporting post 38 so that a rotation shaft 54*a* which connects the cam 54 and the handle 52 can move up and down. The above cam assembly is able to not only rotate but also move back and forth so that a user can easily and visibly recognize the rotation state of the cam 54. Also, when the stopper 44 is inserted into the hooking groove 40 to fix the mobile post 16 and the hooking post 36, the handle 52 is inserted into the slit 60 formed on the side surface of the fixe post 14 and the fixed post supporting post 38, not protruding to the outside.

As shown in FIG. 9, the cam 54 is connected to the handle 52 by the rotation shaft 54*a* and simultaneously the rotation shaft 54*a* can move back and forth. A spring 62 which applies a restoring force in a direction in which the cam 54 advances is installed at the rotation shaft 54*a*.

Thus, as shown in FIG. 9, when the stopper 44 is advanced to fix the mobile post 16 or the hooking post 36, the user erects and pushes the handle 52 into the slit 60 by the spring 62. As the cam 54 advances, the stopper 44 advances. As shown in FIG. 10, when the mobile post 16 or the hooking post 36 is freely moved up and down by retreating the stopper 44, the user pulls out the handle 52 from the slit 60 and rotates the handle 52 90° to retreat the cam 54. Simultaneously, the stopper 44 retreats by a restoring force of the spring 58.

Thus, when the various height container for a vessel according to the present invention in a storage state is to be used, the fixed post 14 and the mobile post 16 are pivoted such that the fixed post 14 is erected vertically to contact the fixed post supporting post 38. Next, to firmly fix the fixed post 14 and the fixed post supporting post 38, the laid handle 52 of the cam assembly installed at the hooking post 36 is pushed above so that the hooking post 36 can locate at an inside contact surface of the fixed post 14 and the fixed post supporting post 38. When the handle 52 is pivoted vertically and pushed into the slit 60, the stopper 44 advances and is hooked by the hooking groove 40 so that the hooking post 36 is fixed to the inner contact surface of the fixed post 14 and the fixed post supporting post 38.

Next, to further make the hooking post 36 firm, a user holding one end of the bar 34 advances the bar 34 so that the other end of the bar 34 can be inserted into the hooking post 36 passing through the fixed post supporting post 38. The user sets the latch 42 on the bar 34 to fix the advanced position of the bar 34.

Next, the cam assembly handle 52 of the mobile post 16 remaining in the fixed post 14 is pulled above or pushed down manually in the same method of the hooking post 36 to adjust the height of the mobile post 16. When the position of a particular hooking groove 40 among a plurality of the hooking grooves is selected, the handle 52 is rotated uprightly and pushed into the selected hooking groove 40. The stopper 44 advances and is hooked by the hooking groove 40 so that the mobile post 16 can be fixed to the fixed post 14.

To keep the variable height container for a vessel after use, in the opposite order to the above-described method, the mobile post 16 is lowered to the lowermost position and the bar 34 is released and the hooking post 36 is lowered. Then, the fixed post 14 is folded onto the bottom plate 12 and the container is kept in such a state.

Here, an additional spring (not shown) is installed at the fixed post 14 to prevent abrupt pivoting when the fixed post 14 is folded or opened and facilitate enabling a user to easily handle heavy containers.

Thus, according to a variable height container for a vessel according to another preferred embodiment of the present invention, the space occupied by the container in storage can be reduced because the container can be stored or moved by being folded. Also, as a plurality of containers can be stacked thereon, costs for storage or transportation can be reduced. In addition to the above, various types of mobile posts and fixed posts can be installed and the fixing means thereof can be formed in various types.

It is noted that the present invention is not limited to the preferred embodiment described above, and it is apparent that variations and modifications by those skilled in the art can be effected within the spirit and scope of the present invention defined in the appended claims.

As described above, according to the variable height container for a vessel according to the present invention, a shipping work can be safely done and additional cost and space can be reduced or removed. Thus, the cost for transportation can be reduced, mass transportation can be possible, shipping is possible at any shipping locations, freight can be loaded anywhere on a deck of a ship or inside the ship. Also, rapid and free transportation can be possible and the container can be kept by being folded so that freight space can be reduced.

What is claimed is:

1. A variable height container for a vessel of which the upper side is open, said container comprising:

a bottom plate where freight is placed;

a plurality of fixed posts installed on said bottom plate;

a mobile post installed at each of said fixed posts to be cable of moving up and down by being guided by the fixed posts to adjust the height of said container; and a fixed means for fixing the mobile post to the fixed posts so that the height of said mobile post can be fixed includes a stopper installed at said mobile posts to be capable of moving back and forth so as to be inserted into or escaped from a hooking groove formed in an inner wall of said fixed post, a cam assembly allowing said stopper to move back and forth while rotating, and a handle connected to said cam assembly for rotating said cam assembly, wherein said mobile post is piston-shaped and slides along said fixed post while a part of said mobile post is inserted into a space formed in said fixed posts.

* * * * *

UNITED STATES PATENT AND TRADEMARK OFFICE

CERTIFICATE OF CORRECTION

PATENT NO. : 6,227,397 B1
DATED : May 8, 2001
INVENTOR(S) : Kim

It is certified that error appears in the above-identified patent and that said Letters Patent is hereby corrected as shown below:

Title page,
Item [76] Inventor, please delete "Jum-kyu" and add -- Jum-gyu --.

Signed and Sealed this

Twenty-sixth Day of February, 2002

*Attest:*

*Attesting Officer*

JAMES E. ROGAN
*Director of the United States Patent and Trademark Office*